US008631948B2

(12) United States Patent
Yang et al.

(10) Patent No.: US 8,631,948 B2
(45) **Date of Patent: *Jan. 21, 2014**

(54) DISH RACK WITH ADJUSTABLE SPOUT AND REMOVABLE DRIP TRAY

(75) Inventors: Frank Yang, Rancho Palos Verdes, CA (US); Joseph Sandor, Santa Ana Heights, CA (US); Chih-Hong Hsieh, West Covina, CA (US)

(73) Assignee: Simplehuman LLC, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/324,796

(22) Filed: Dec. 13, 2011

(65) Prior Publication Data

US 2012/0085715 A1 Apr. 12, 2012

Related U.S. Application Data

(63) Continuation of application No. 11/601,441, filed on Nov. 17, 2006, now Pat. No. 8,074,813.

(51) Int. Cl.
*A47G 19/08* (2006.01)

(52) U.S. Cl.
USPC ..... 211/41.3; 211/41.4

(58) Field of Classification Search
USPC ..... 211/41.1–41.9, 85.25, 85.21; 220/487, 220/488, 572; 4/654, 656; D32/3, 55; 134/56 D, 57 D, 58 D
See application file for complete search history.

(56) References Cited

U.S. PATENT DOCUMENTS

| | | | | | |
|---|---|---|---|---|---|
| 508,885 | A | * | 11/1893 | Johnston | 211/85.25 |
| 591,377 | A | * | 10/1897 | Bunce | 220/572 |
| 1,742,150 | A | | 12/1929 | Rollins | |
| 1,789,232 | A | | 1/1931 | Hertz | |
| 2,443,404 | A | * | 6/1948 | Tallarico | 211/41.4 |
| 2,864,509 | A | | 12/1958 | Watral | |
| 3,050,073 | A | | 8/1962 | McMillan | |
| 3,070,812 | A | * | 1/1963 | Skrmetta | 4/654 |
| 3,927,703 | A | | 12/1975 | Beaubien | |
| 3,964,378 | A | * | 6/1976 | Dunkelman | 99/425 |
| 4,046,261 | A | | 9/1977 | Yake | |
| 4,370,762 | A | * | 2/1983 | Heil | 4/654 |
| 4,854,537 | A | | 8/1989 | Welch | |
| 4,927,033 | A | | 5/1990 | Patera et al. | |
| 5,119,943 | A | | 6/1992 | Hoang | |
| 5,249,590 | A | | 10/1993 | Jacobus et al. | |
| 5,704,492 | A | | 1/1998 | Bartko | |
| 6,125,548 | A | | 10/2000 | Dunn et al. | |
| 6,179,134 | B1 | | 1/2001 | Pine et al. | |
| 6,446,280 | B1 | * | 9/2002 | Moore, Jr. | 4/651 |

(Continued)

FOREIGN PATENT DOCUMENTS

DE 706307 5/1941

OTHER PUBLICATIONS

Partial International Search Report of related case PCT Application No. PCT/US2009/000600.

*Primary Examiner* — Jonathan Liu
*Assistant Examiner* — Patrick Hawn
(74) *Attorney, Agent, or Firm* — Liu & Liu

(57) ABSTRACT

A dish rack has a wireframe, a drip tray having a base and a dish-receiving region provided on the base, and a drain channel that is removably coupled to the bottom of the base at the location of the dish-receiving region.

14 Claims, 8 Drawing Sheets

(56) References Cited

U.S. PATENT DOCUMENTS

| | | | | |
|---|---|---|---|---|
| 6,491,170 | B1 * | 12/2002 | Madela | 211/41.3 |
| 6,848,585 | B2 | 2/2005 | VanLandingham | |
| 7,228,975 | B2 | 6/2007 | Yang et al. | |
| 7,458,470 | B2 | 12/2008 | Jerstroem et al. | |
| 2004/0238464 | A1 * | 12/2004 | Cheung | 211/41.3 |
| 2005/0167374 | A1 * | 8/2005 | Yang et al. | 211/41.18 |
| 2005/0205499 | A1 * | 9/2005 | Botner | 211/34 |
| 2005/0269273 | A1 * | 12/2005 | Yang et al. | 211/41.4 |
| 2006/0137725 | A1 * | 6/2006 | Yang et al. | 134/58 D |
| 2006/0169652 | A1 * | 8/2006 | Yang et al. | 211/41.3 |
| 2006/0237379 | A1 * | 10/2006 | Yang et al. | 211/41.4 |
| 2006/0283817 | A1 * | 12/2006 | Yang et al. | 211/41.4 |
| 2007/0131629 | A1 * | 6/2007 | Sullivan et al. | 211/41.3 |
| 2007/0144984 | A1 * | 6/2007 | Sullivan et al. | 211/41.3 |
| 2007/0151937 | A1 * | 7/2007 | Gillisie | 211/41.5 |
| 2008/0029465 | A1 * | 2/2008 | Yang et al. | 211/41.5 |
| 2008/0083678 | A1 | 4/2008 | Graute | |
| 2008/0116155 | A1 * | 5/2008 | Yang et al. | 211/41.3 |
| 2008/0302740 | A1 | 12/2008 | Moser et al. | |
| 2009/0152218 | A1 * | 6/2009 | Yang et al. | 211/41.4 |
| 2009/0211994 | A1 * | 8/2009 | Yang et al. | 211/41.4 |

* cited by examiner

DISH RACK WITH ADJUSTABLE SPOUT AND REMOVABLE DRIP TRAY

This application is a Continuation of U.S. patent application Ser. No. 11/601,441, filed Nov. 17, 2006. This application is incorporated herein by reference.

BACKGROUND OF THE INVENTION

1. Field of the Invention

The present invention relates to dish racks, and in particular, to a dish rack having a removable drip tray. The drip tray can include an adjustable spout.

2. Description of the Prior Art

Dish racks are commonly used on kitchen countertops for positioning plates, bowls, cups and utensils to let them dry after they have been washed. The water from the washed plates, bowls, cups and utensils will typically drip on to the base of the dish rack, and the water can be drained to the kitchen sink by tilting the base.

Unfortunately, these conventional dish racks suffer from several drawbacks. First, they lack an effective way of draining the water collected on the base to the kitchen sink. Tilting the base can be difficult (and dangerous) if the dish rack is fully loaded with dishes, bowls, utensils and other items.

Second, the conventional dish racks are typically positioned on a countertop adjacent the kitchen sink. Unfortunately, if the dish rack is inadvertently pushed or rattled (e.g., by a user, a child or a pet), the water that has collected on the base may be splashed out of the base on to the countertop or the floor.

Thus, there remains a need for a dish rack that can effectively drain the water collected on the base.

SUMMARY OF THE DISCLOSURE

It is an object of the present invention to provide a dish rack that effectively drains water that has been collected on a base or a tray.

It is another object of the present invention to provide a dish rack that can be used in different counter-top situations.

In order to accomplish the objects of the present invention, the present invention provides a dish rack having a wireframe, a drip tray having a base and a dish-receiving region provided on the base. The dish rack includes a drain channel that is removably coupled to the bottom of the base at the location of the dish-receiving region.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
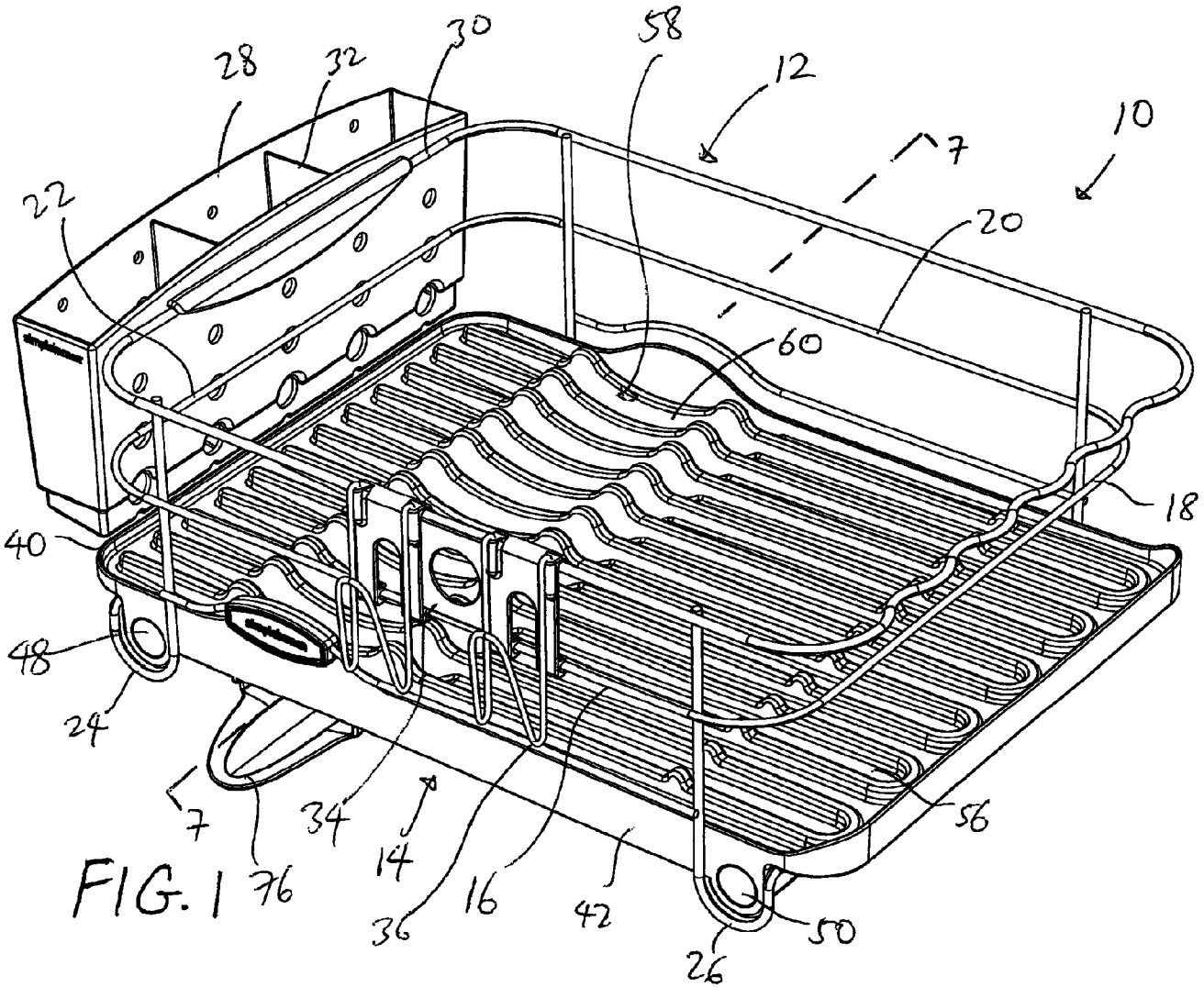
FIG. 1 is a top perspective view of a dish rack according to one embodiment of the present invention.
Figure 2:
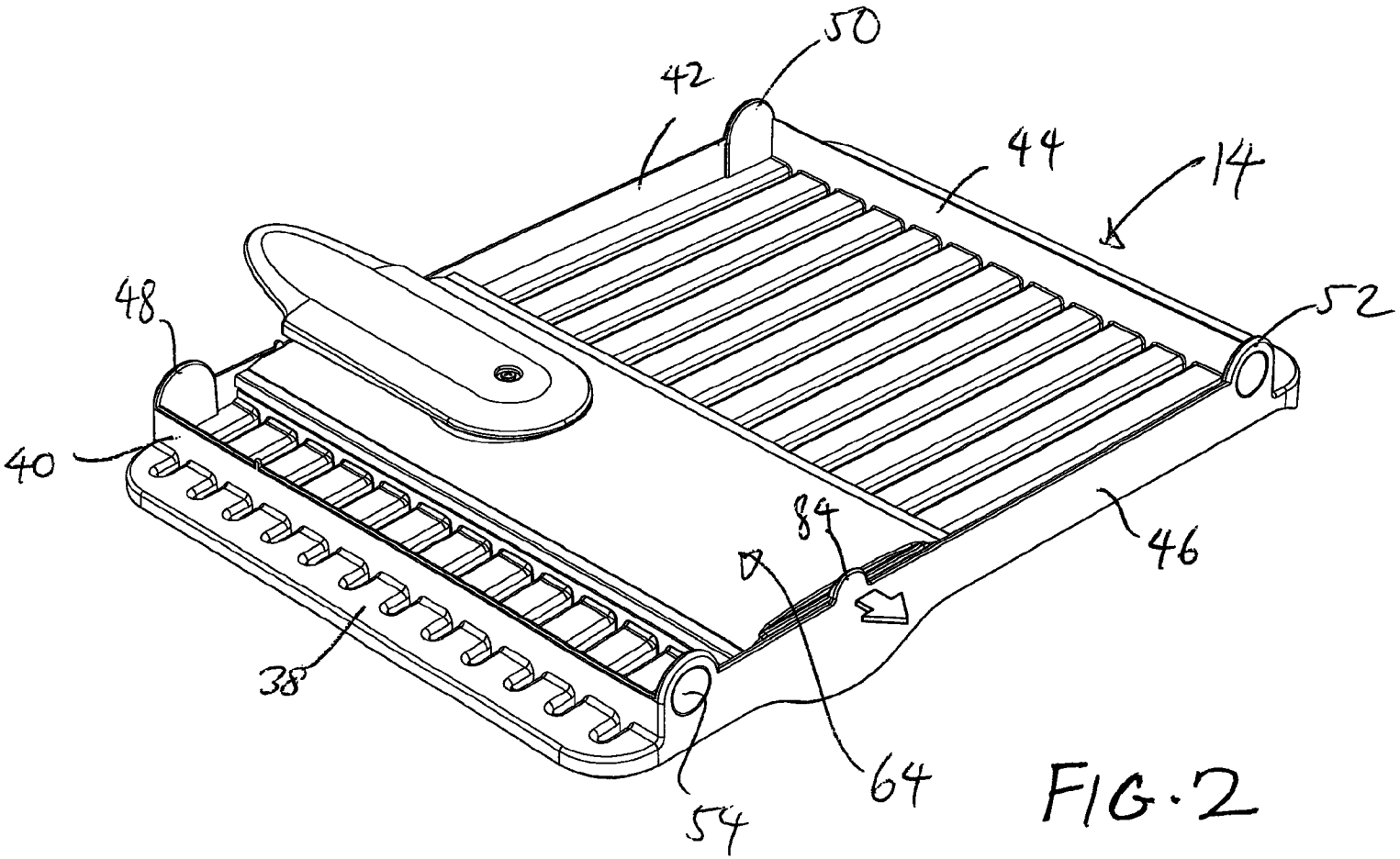
FIG. 2 is a bottom perspective view of the drip tray of the dish rack of FIG. 1.

FIG. 1 illustrates a dish rack 10 having a generally four-sided (e.g., rectangular) configuration. The dish rack 10 has a wireframe 12 and a drip tray 14. The wireframe 12 can be made of stainless steel or other similar metal, with the wires of the wireframe 12 defining four sides 16, 18, 20 and 22. The wireframe 12 defines four legs, with one leg at each corner of the wireframe 12, and with only two legs 24 and 26 being shown in FIG. 1.

Any number of accessories can be provided with the dish rack 10. For example, a collector tray 28 can be suspended from a top wire 30 on the side 22 of the wireframe 12. The collector tray 28 can be made of plastic, and have four walls that define an interior space that can be further divided into separate sections by dividing walls 32. The collector tray 28 can be used to hold knives, forks, spoons, and other utensils, and can even hold baby bottle nipples and other smaller washable items. As another example, a cup or wine glass holder 34 can be suspended from the top wire 30 on the side 16 of the wireframe 12. The holder 34 can be made of plastic, and have U-shaped stainless steel hooks 36 that are adapted to hold inverted cups or glasses.

Figure 3:
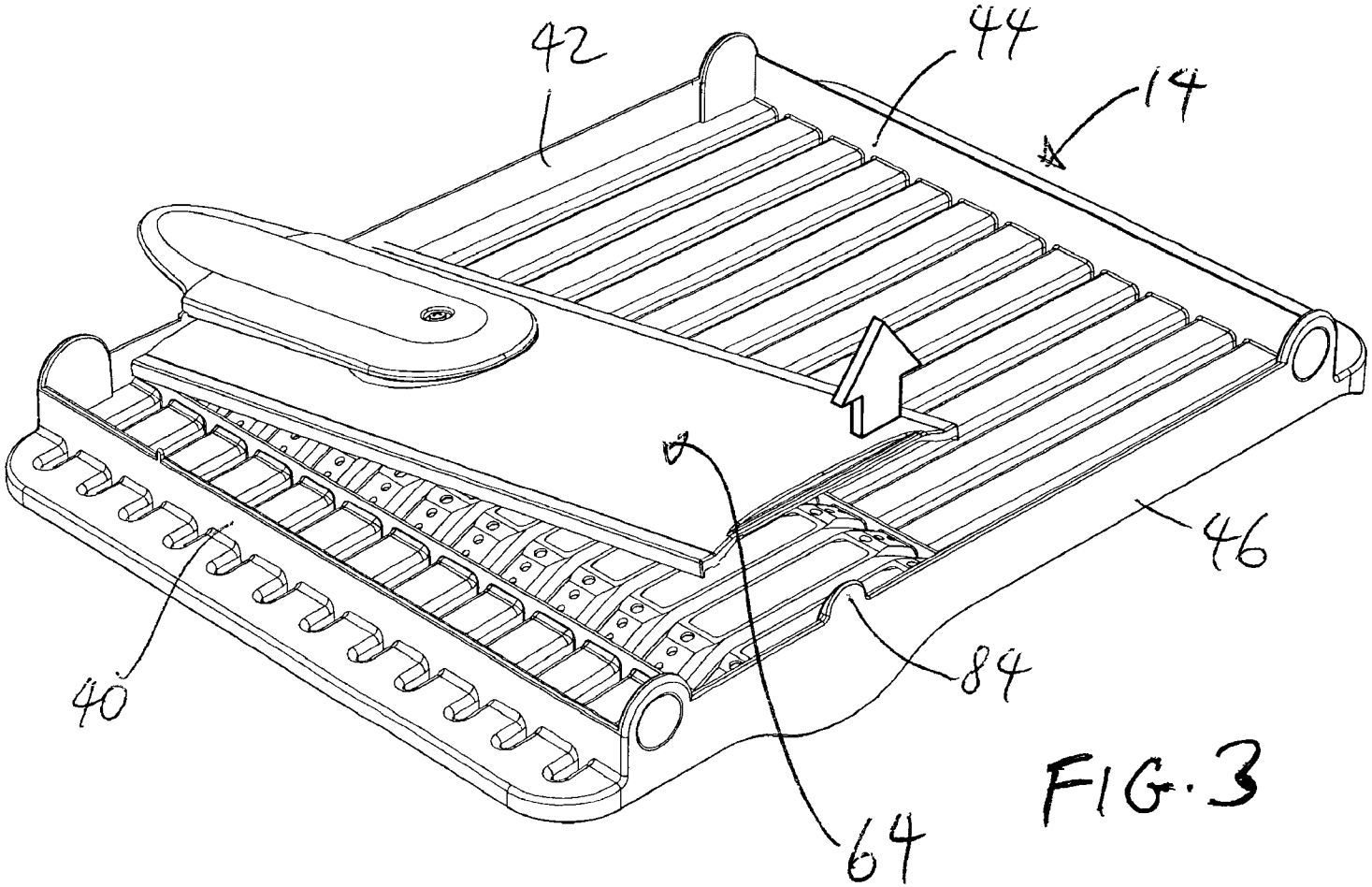
FIG. 3 is an exploded bottom perspective view of the drip tray of FIG. 2 showing the drain channel partially separated from the drip tray.
Figure 4:
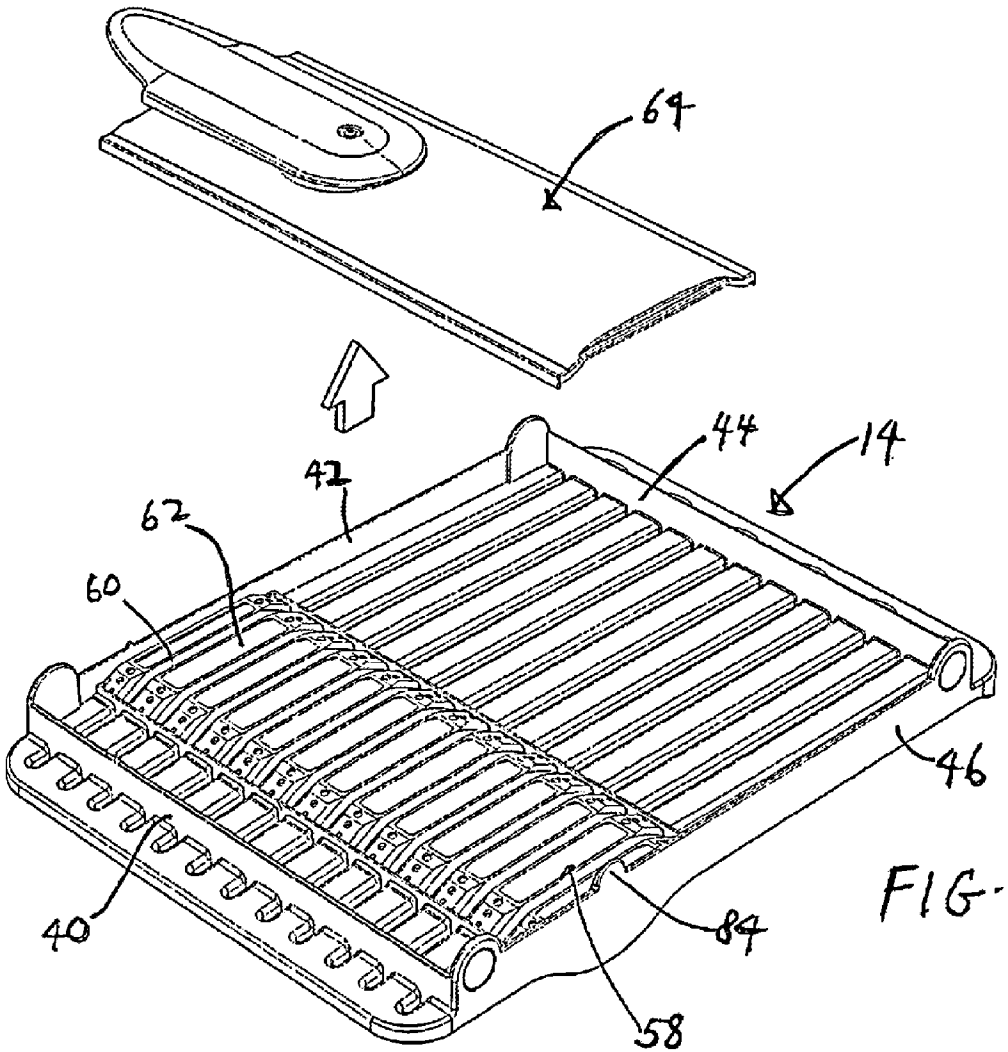
FIG. 4 is an exploded bottom perspective view of the drip tray of FIG. 2 showing the drain channel completely separated from the drip tray.

Referring also to FIGS. 2-4 and 7-8, a removable drip tray 14 can be positioned at the bottom of the wireframe 12. The drip tray 14 can be made of a different material from the wireframe 12, such as plastic. The drip tray 14 has a base 38 that has four short walls 40, 42, 44, 46 extending downwardly therefrom, with legs 48, 50, 52, 54 extending from these walls 40, 42, 44, 46 to elevate the base 38 when the legs 48, 50, 52, 54 are placed on a flat surface (e.g., a kitchen counter-top). The legs 48, 50, 52, 54 are adapted to be fitted on the wireframe either adjacent to, or on, corresponding legs 24, 26 in the wireframe 12. Referring to FIG. 1, a plurality of elongated grooves 56 can be provided (e.g., molded) from the top surface of the base 38, and are adapted to guide water towards a dish-receiving region 58. Specifically, the base 38 is angled from the walls 40 and 44 towards the dish-receiving region 58 so that water that has collected on the base 38 can be guided by the grooves 56 to flow to the dish-receiving region 58. The dish-receiving region 58 is formed in the base 38 at a location that is closer to one wall 40 than to the opposite wall 44. A plurality of dish-dividing walls 60 is provided at the dish-receiving region 58, and corresponding elongated openings 62 are provided in the base 38 between each pair of dish-dividing walls 60. The dish-dividing walls 60 can extend slightly below the horizontal plane of the base 38, as best shown in FIGS. 3 and 4. Thus, a dish (not shown) can be received between two adjacent dish-dividing walls 60, with an edge of the dish extending through the elongated opening 62.

Figure 5:
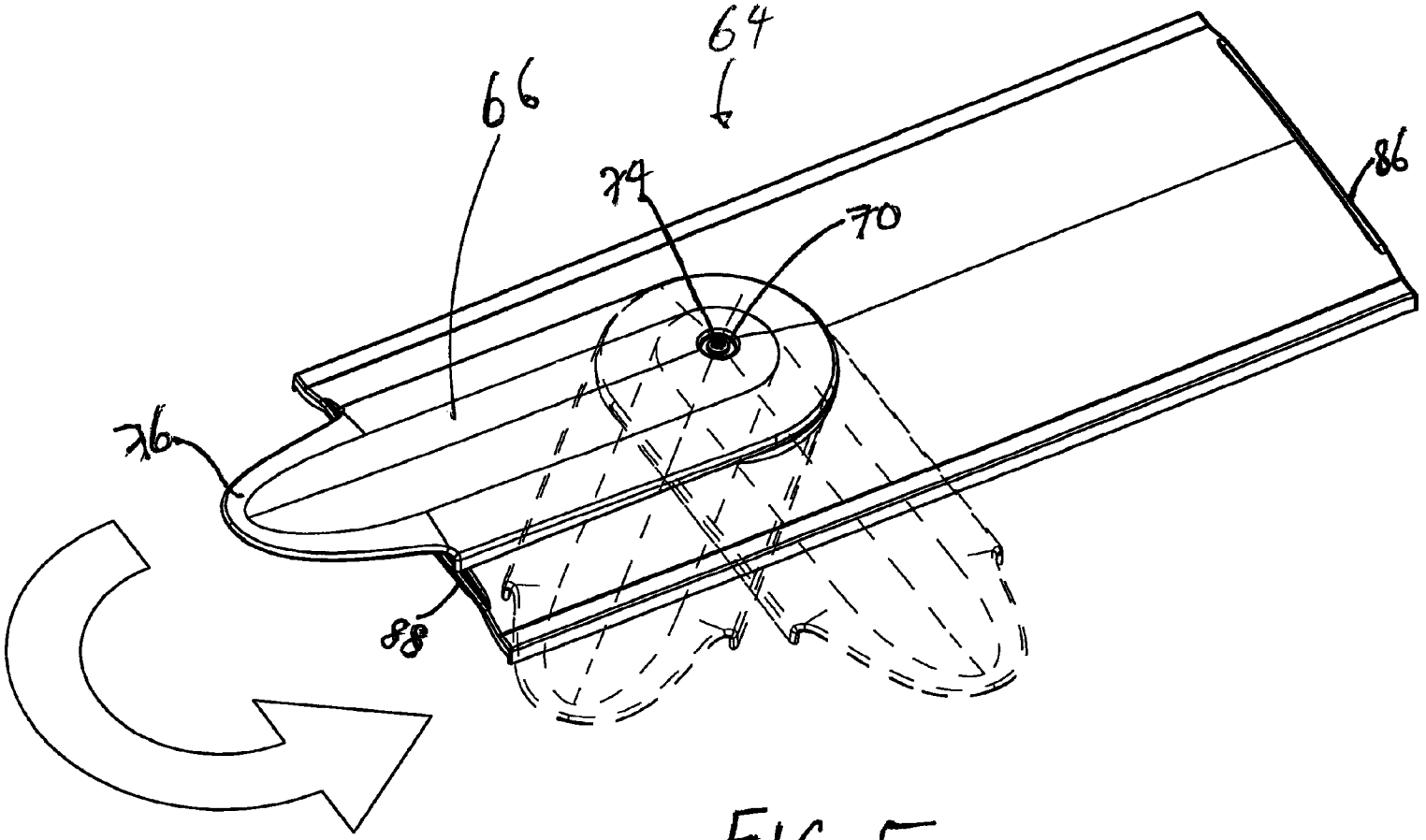
FIG. 5 is a bottom perspective view of the drain channel of the dish rack of FIG. 1
Figure 6:
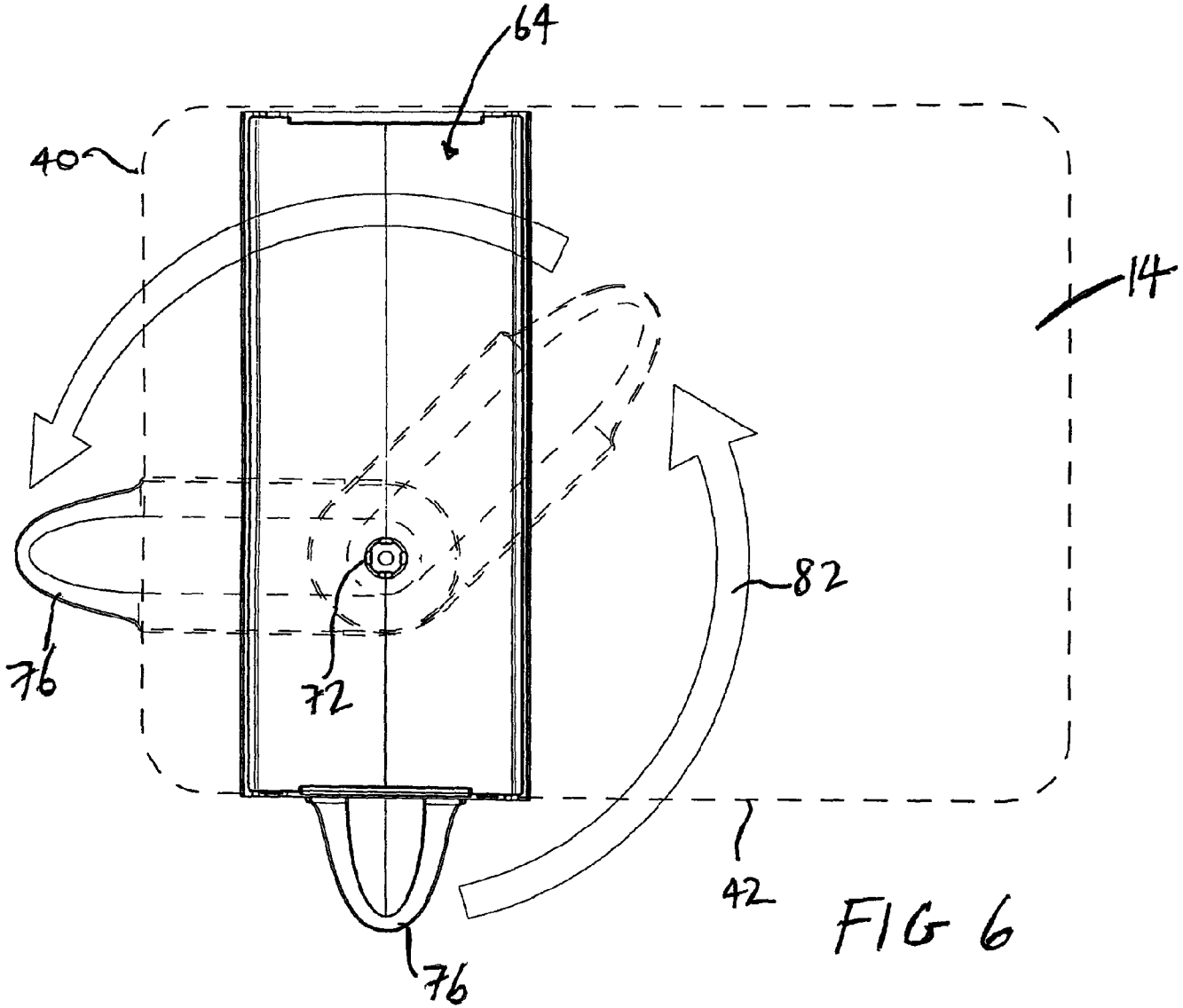
FIG. 6 is a top view of the drain channel of FIG. 5 shown in the context of the drip tray of FIG. 1.
Figure 7:
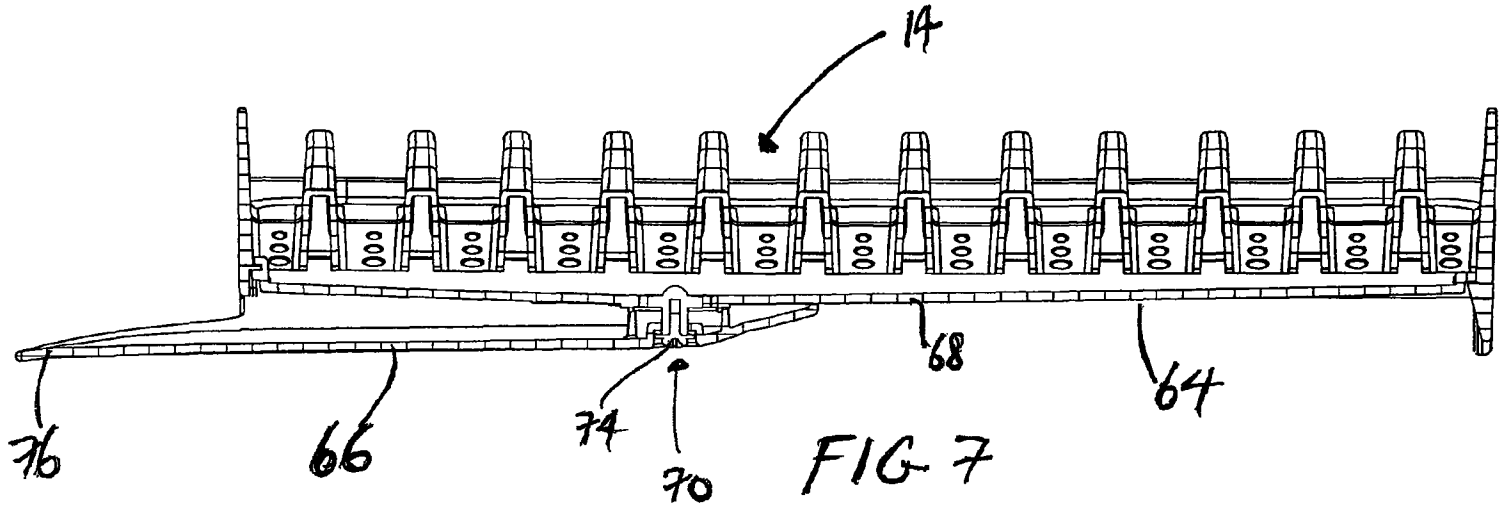
FIG. 7 is a side cross-sectional view of the drip tray of FIG. 1 taken along line 7-7 thereof.

Referring also to FIGS. 5-7, a drain channel 64 can be removably attached to the bottom of the drip tray 14 at a location below the dish-receiving region 58. The drain channel 64 has a concave spout 66 that is angled downwardly with respect to the horizontal plane of the drip tray 14, so that the spout 66 can be adapted to allow water that has collected on the base 38 to be directed to a kitchen sink. In particular, the water on the base 38 flows along the grooves 56 to the dish-receiving region 58 where the water is then flowed through the elongated openings 62 to the drain channel 64. As best shown in FIG. 7, the base 68 of the drain channel 64 is angled downwardly from its side edges towards an outlet 70 that is positioned at the lowest vertical point of the drain channel 64. This will allow water on the drain channel 64 to flow towards the outlet 70. The water passes through openings 72 (see FIG. 6) in the outlet 70 to the spout 66 where the water can flow down the spout 66.

The spout 66 is rotatably connected to the drain channel 64 at the location of the outlet 70. As shown in FIGS. 5, 6 and 7, a screw 74 can be used to connect the spout 66 to the base 68 of the drain channel 64. The spout 66 can be rotated to position the outlet 76 of the spout 66 at one of two different walls 40 or 42 of the drip tray 14. Specifically, the outlet 76 of the spout 66 can be positioned along the wall 42 (see FIGS. 1 and 6) of the drip tray 14 if the wall 42 is positioned adjacent a kitchen sink. On the other hand, the outlet 76 of the spout 66 can be positioned along the wall 40 (see FIG. 1) of the drip tray 14 if the wall 40 is positioned adjacent a kitchen sink. Thus, by allowing the spout 66 to be adjusted to be positioned adjacent both the longer wall 42 and the shorter wall 40, the dish rack 10 can be positioned adjacent the kitchen sink in any kitchen to adapt to different counter-top situations in different households.

The spout 66 can be rotated through an angle of 270 degrees, as shown by the arrow 82 in FIG. 6. In this regard, the presence of the leg 48 blocks the shorter 90 degree rotation path of the spout 66 from the wall 42 to the wall 40, so the spout 66 needs to be rotated through an angle of 270 degrees, as shown by the arrow 82 in FIG. 6. As an alternative, the drain channel 64 can be removed from the drip tray 14 and the spout 66 rotated in any manner desired before re-attaching the drain channel 64 to the drip tray 14.

Figures 8A, 8B, 8C:
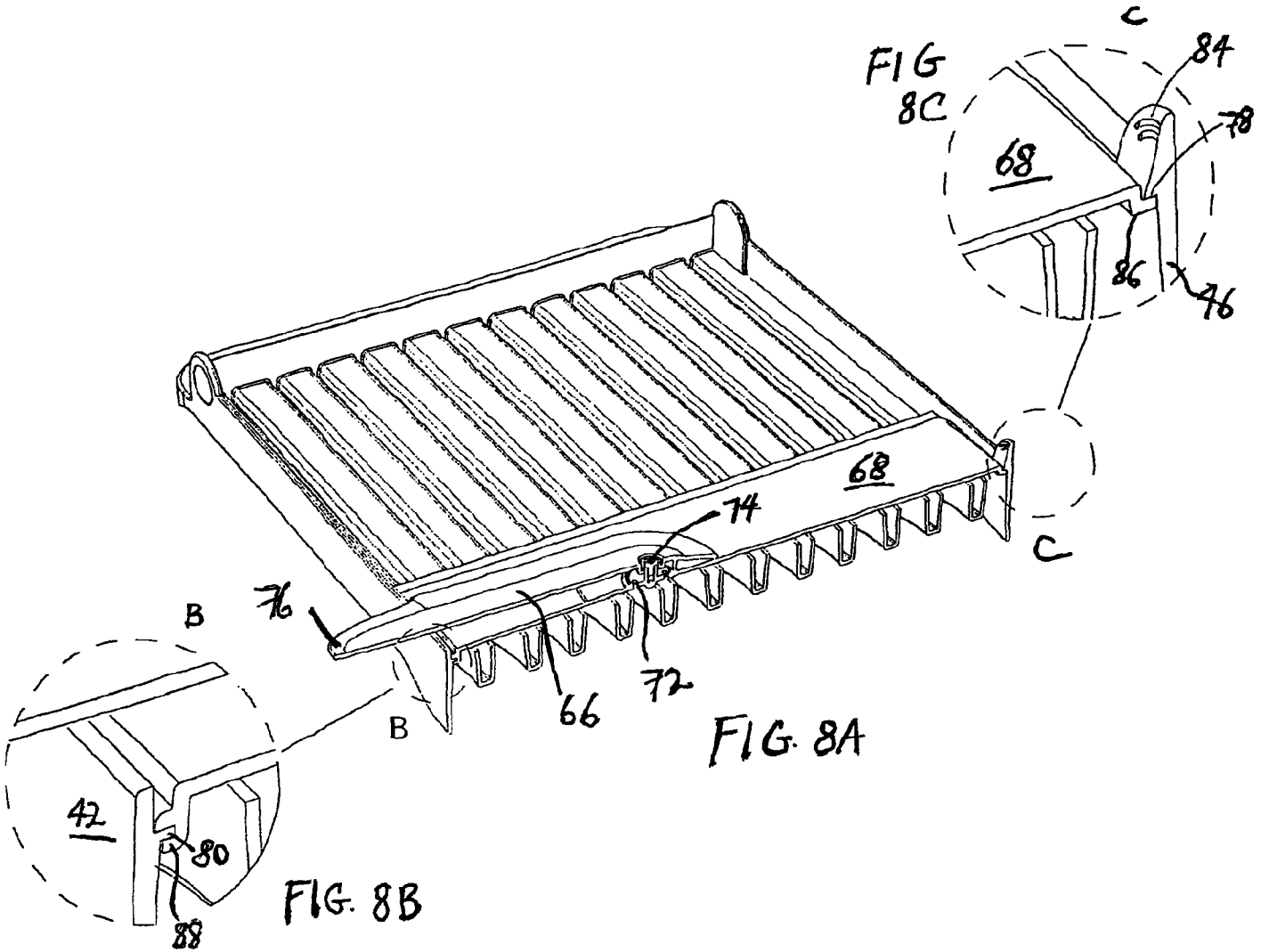
FIG. 8A is a bottom perspective cross-sectional view of the drip tray of FIG. 1.
FIG. 8B is an enlarged sectional view of the region B in FIG. 8A.
FIG. 8C is an enlarged sectional view of the region C in FIG. 8A.

FIGS. 2-4, 7 and 8A-8C illustrate how the drain channel 64 is removably attached to the drip tray 14. Referring to FIGS. 8A and 8C, a tab 84 is provided along the wall 46 at the dish-receiving region 58. The tab 84 has a step 78 at the location where the tab 84 transitions into the wall 46. Referring to FIGS. 8A and 8B, the opposing wall 42 has a flange 80. In addition, one end of the drain channel 64 has a shoulder 86 which is adapted to be snap-fitted under the step 78, and the other end of the drain channel 64 has a gripping piece 88 that has an internal space for receiving the flange 80. To attach the drain channel 64 to the drip tray 14, the user first fits the flange 80 into the space defined by the gripping piece 88 (see FIG. 8B), and then pushes the drain channel 64 against the bottom of the drip tray 14 until the shoulder 86 is snap-fitted under the step 78 (see FIG. 8C). To detach the drain channel 64 from the drip tray 14, the user pushes on the tab 84 to release the shoulder 86 from the step 78, thereby allowing the user to slide the gripping piece 88 away from the flange 80. Even though the present invention describes one embodiment for removably connecting the drain channel 64 to the drip tray 14, other connection mechanisms can be utilized without departing from the scope of the present invention.

While the description above refers to particular embodiments of the present invention, it will be understood that many modifications may be made without departing from the spirit thereof. The accompanying claims are intended to cover such modifications as would fall within the true scope and spirit of the present invention. For example, the spout 66 does not need to be rotatable.

What is claimed is:

1. A dish rack, comprising:

a body defining an interior having a structure for supporting dishes, the body having a bottom;

a leg supporting each corner of the body, providing a space below the bottom above a supporting surface on which the leg rests; and a spout rotatably connected to an outlet of the bottom, in the space below the bottom, wherein the outlet is located away from edges of the bottom, wherein the bottom is configured such that water drained on the bottom is directed in a direction away from the edges towards the outlet to drain via the spout, wherein the spout is positionable between a first position in which the spout extends between a first pair of legs at a first side of the body and a second position in which the spout extends between a second pair of legs at a second side of the body orthogonal to the first side of the body, wherein the spout extends beyond the edges of the bottom at the first position and the second position, and wherein the spout comprises an open channel structure wherein sections along its longitudinal axis are open.

2. The dish rack as in claim 1, wherein the first pair of legs and the second pair of legs share a common leg.

3. The dish rack as in claim 1, wherein the body comprises a wire frame.

4. The dish rack as in claim 3, wherein the body comprises a drip tray having a base, and the bottom is defined by the base of the drip tray.

5. The dish rack as in claim 4, wherein the drip tray is removably supported by the wireframe.

6. The dish rack as in claim 5, wherein the drip tray comprises a longitudinal drain channel that is removably coupled to and supported from the base of the drip tray, and the spout is rotatably coupled to the bottom of the drain channel.

7. The dish rack as in claim 5, wherein the structure for supporting dishes is provided on the drip tray.

8. The dish rack as in claim 1, wherein the structure for supporting dishes is made of a plastic material.

9. The dish rack as in claim 1, wherein the spout is pivotally attached to the bottom of the body.

10. The dish rack as in claim 9, wherein the spout is pivotally attached to the bottom of the body for rotation of the spout about a pivot axis, and wherein the spout is positionable between the first and second positions by rotating the spout about the pivot axis.

11. The dish rack as in claim 10, wherein an opening is provided along the pivot axis to allow water to drain from the bottom of the body to the spout.

12. The dish rack as in claim 11, wherein the spout comprises an open channel structure.

13. The dish rack as in claim 1, wherein the spout has an open concave longitudinal channel structure.

14. The dish rack as in claim 6, wherein the spout has an open concave longitudinal channel structure.

* * * * *